US005236101A

United States Patent [19]

Dugmore

[11] Patent Number: 5,236,101

[45] Date of Patent: Aug. 17, 1993

[54] RADIATION PROOF TAMPER-INDICATING CONTAINER

[76] Inventor: Peter B. Dugmore, 4 Swanmore Road, Rondebosch, Cape, South Africa

[21] Appl. No.: 778,236

[22] Filed: Oct. 17, 1991

[30] Foreign Application Priority Data

Oct. 18, 1990 [ZA] South Africa ..... 90/8346
Oct. 31, 1990 [ZA] South Africa ..... 90/8736

[51] Int. Cl.[5] ..... B65D 41/02

[52] U.S. Cl. ..... 220/265; 220/306; 220/359; 220/377; 220/450; 220/454; 220/662; 215/12.1; 215/12.2; 215/365; 215/230; 215/250; 215/317; 206/455; 206/459.5; 250/515.1; 250/519.1

[58] Field of Search ..... 220/265, 306, 359, 377, 220/450, 454, 662; 215/12.1, 12.2, 365, 230, 250, 317; 206/455, 459; 250/515.1, 519.1

[56] References Cited

U.S. PATENT DOCUMENTS

| | | | |
|---|---|---|---|
| 3,655,985 | 4/1972 | Brown et al. | 206/459 X |
| 3,793,528 | 2/1974 | Takeda | 250/482.1 X |
| 3,845,316 | 10/1974 | Tureek | 250/519.1 |
| 4,282,441 | 8/1981 | Filoramo | 250/515.1 |
| 4,392,576 | 7/1983 | Berger et al. | 215/12.2 X |
| 4,489,841 | 12/1984 | Thompson | 215/203 |
| 4,502,605 | 3/1985 | Wloszczyna | 215/230 |
| 4,574,974 | 3/1986 | von Holdt | 220/306 |
| 4,603,785 | 8/1986 | Gach | 215/230 |
| 4,682,701 | 7/1987 | Katz . | |
| 4,747,500 | 5/1988 | Gach et al. | 215/250 |
| 4,826,039 | 5/1989 | Landis | 220/306 X |
| 4,833,334 | 5/1989 | Valy et al. | 250/515.1 |
| 4,844,961 | 7/1989 | Akao | 206/455 X |
| 4,860,892 | 8/1989 | Roberts et al. | 215/230 X |
| 4,877,143 | 10/1989 | Travisano | 215/230 |
| 4,895,266 | 1/1990 | Begley | 215/230 |

FOREIGN PATENT DOCUMENTS

| | | | |
|---|---|---|---|
| 2543351 | 9/1984 | France . | |
| 2145242 | 6/1987 | Japan | 206/455 |
| 1241550 | 9/1989 | Japan | 206/455 |
| 85/02165 | 5/1985 | PCT Int'l Appl. . | |
| 994258 | 6/1965 | United Kingdom | 206/455 |

*Primary Examiner*—Stephen P. Garbe
*Assistant Examiner*—Stephen Cronin
*Attorney, Agent, or Firm*—Burns, Doane, Swecker & Mathis

[57] ABSTRACT

The invention relates to a tamper-indicating radiation-proof film container. The container comprises a canister having an opening defined therein, and a closure member having a peripheral canister-engaging portion. A tamper-indicating seal is located between adjacent contact surfaces of the canister-engaging portion and the canister, and the closure member is translucent for enabling the condition of the tamper-indicating seal to be viewed. Shielding means are provided for shielding the contents of the container from ionising radiation. The shielding means may be in the form of an intermediate lead layer and an inner barium-impregnated plastics layer which lines both the canister and the closure member. The tamper-indicating seal incorporates indicia containing information relating to the contents of the container. The primary advantage of the film container of the invention is that it allows photographic film to be sold with the purchaser safe in the knowledge that the film has neither been tampered with, nor damaged by X-radiation. The suitably protected photographic film also does not need to be removed from luggage which is to be X-rayed.

9 Claims, 2 Drawing Sheets

Fig. 1
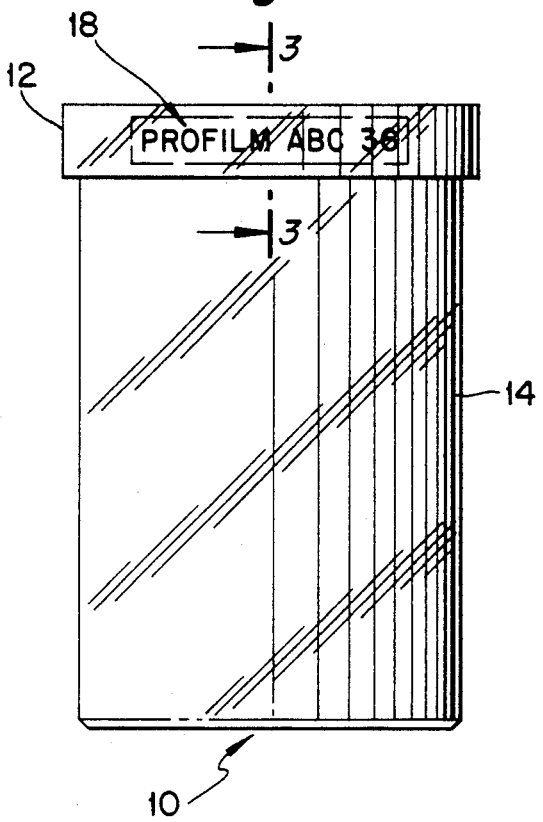
Fig. 2
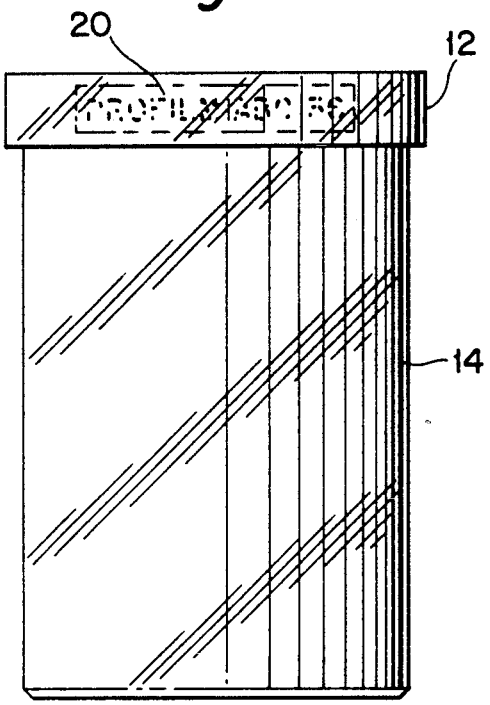
Fig. 3B
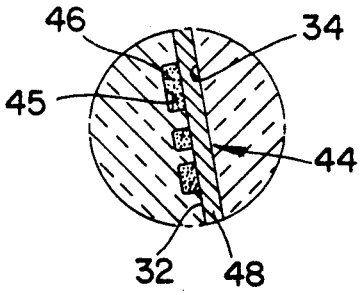
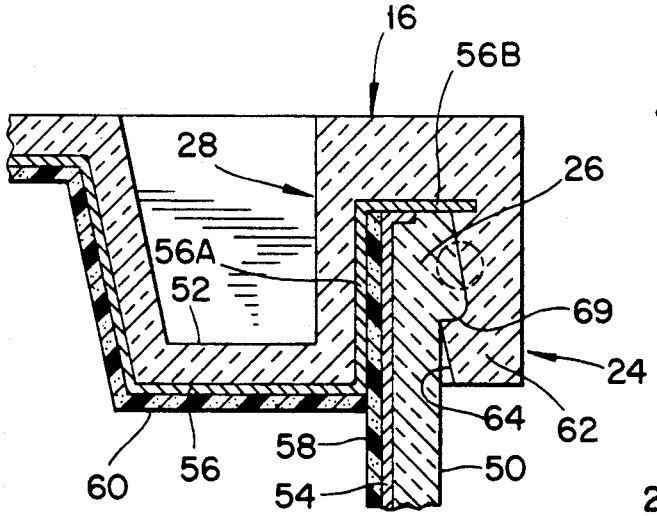
Fig. 3
Fig. 3A
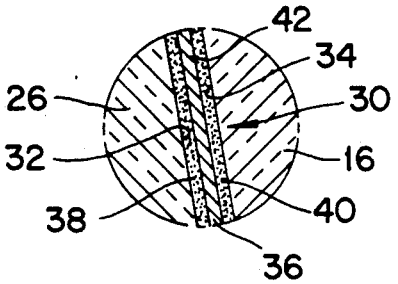

Fig. 5
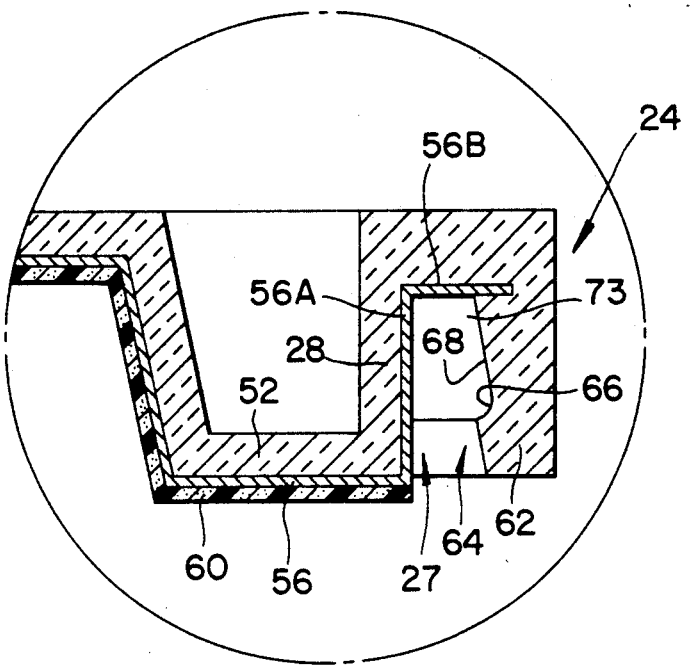
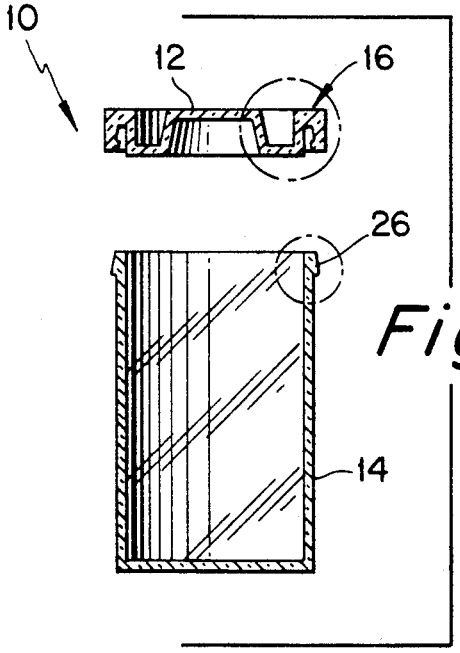
Fig. 4
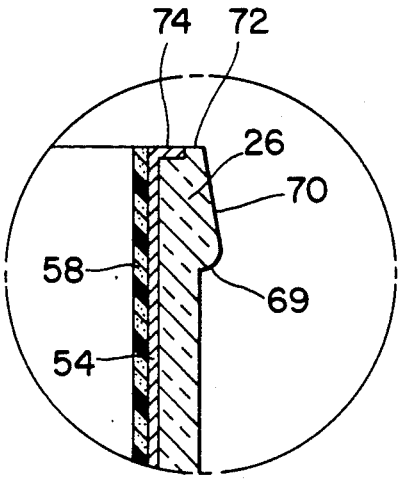
Fig. 6

RADIATION PROOF TAMPER-INDICATING CONTAINER

BACKGROUND OF THE INVENTION

This invention relates to a radiation-proof tamper-indicating film container.

Nowadays, most 35 mm photographic film is sold and stored in transparent canisters. This has the advantage that, once the cardboard box comprising the outer packaging of the film has been removed, essential information about the type of film contained within the canister can still be obtained without opening the canister. Furthermore, in many parts of the world, unscrupulous dealers sell, as new film, either (at best) old stock, or (at worst) film cassettes containing only the film leader strip which suggests a full roll of film where none, in fact, exists.

A transparent canister therefore enables the user to establish instantly the type of film contained therein, as well as the essential photographic information relating thereto. Furthermore, it enables the buyer to make at least a superficial examination of the film cassette in order to establish whether it has been tampered with or not.

The major short-coming of a transparent film canister is that it increase the possibility of damage to the film due to inadvertent exposure to a light source. Furthermore, a transparent container provides little or no protection from the other forms of radiation to which photographic film may be exposed. A prime example of this is the possible exposure of photographic film to X-radiation during baggage checks at airport terminals.

The potential for damage to both developed and undeveloped photographic film subjected to X-radiation is an established fact. For travellers whose baggage is subject to X-ray security screening, it represents at least four areas of concern.

Firstly, there is a possibility that the "film-safe" X-ray machines used to examine hand luggage are incorrectly calibrated or maintained, resulting in higher-than-recommended levels of X-radiation.

Secondly, as increasingly mentioned in most leading photographic texts, and as proved in extensive research by the American Society of Magazine Photographers, X-radiation is cumulative in its effect on photographic film. One or two exposures of film to X-ray screening in a "film-safe" device may well have no deleterious effect. However, for the traveller moving through a number of such X-ray checks, cumulative exposures may well damage film.

Thirdly, as instanced by the same authority, the higher the ISO rating of film (the "faster" the film is) the greater is its sensitivity to X-radiation. A "film-safe" X-ray machine calibrated not to damage conventionally rated films in the ISO 25–400 range offers no assurance of X-ray protection to the ultra-fast films of around ISO 800–2000 used by professionals today.

Finally, there exists the possibility of conventional, as opposed to "fail-safe" X-ray screening machines, being used on luggage committed to the hold of an aircraft.

While many airports issue warnings to remove all photographic film from luggage prior to it being X-rayed, others do not. Many travellers or professional photographers forget to do so and their photographic films may consequently get damaged.

SUMMARY OF THE INVENTION

According to the invention there is provided a tamper-indicating container comprising:

a) a canister having an opening defined therein;

b) a closure member having a peripheral canister-engaging portion;

c) a tamper-indicating seal located between adjacent contact surfaces of the canister-engaging portion and the canister, at least part of the closure member being translucent for viewing the condition of the tamper-indicating seal;

d) shielding means for shielding the contents of the container from ionising radiation.

In a preferred form of the invention, the tamper-indicating seal incorporates indicia containing information relating to the contents of the container.

Conveniently, the canister-engaging portion has a depending outer-peripheral translucent skirt which incorporates the window.

In one form of the invention, the tamper-indicating seal may comprise a frangible strip laminated between adjacent contact surfaces of the canister-engaging portion of the closure member and the canister.

The frangible strip may be in the form of a printed strip of foil or film bonded by means of adhesive layers both to an inner contact surface of the canister-engaging portion of the closure member and to an outer contact surface of a lip forming part of the canister.

In one form of the invention, the strip of foil or film may be embedded within a thermoplastic resin.

In an alternative form of the invention, the indicia may comprise indents formed in at least one of the adjacent contact surfaces of the canister-engaging portion and the canister, the indents being filled with a coloured ink material, and a bonding agent being interposed between the ink material and the opposed contact surface, whereby removal of the closure member from the canister causes at least some of the ink material which is bonded to the bonding agent to be lifted away from the indents so as to indicate tampering.

The closure member may have an outer layer formed from a translucent plastics material and an inner layer formed from the shielding means, the shielding means terminating before the tamper-indicating seal.

In a preferred form of the invention, the shielding means is in the form of a layer of lead which lines and forms an inner layer for both the canister and the closure member, thereby forming a complete surround for shielding the contents of the container.

The shielding means preferably includes a layer of material which contains barium.

More preferably, the shielding means is constituted by an intermediate layer of lead bonded to an inner layer of a barium-impregnated plastics material.

The walls of the container are conveniently constituted by the intermediate layer of lead laminated between the inner layer of barium-impregnated plastics material and outer layer of a relatively rigid plastics material.

The container is advantageously in the form of a round-cylindrical canister and a circular closure member, the container being sized to house complementally a single roll of photographic film.

The canister may be provided with an outer peripheral lip adjacent the opening thereof, and the canister-engaging formation may comprise an inner wall and an elastically deformable outer wall defining in combination a substantially U-shaped channel complemental with the lip, the outer wall having a re-entrant portion formed towards the free end thereof behind which the peripheral lip is adapted to engage in a snap fit, the contact surfaces being located on the outer surface of the outer peripheral lip and the inner surface of the outer wall.

The shielding means preferably extends to the upper edge of the lip of the canister extends along the outer surface of the inner wall of the canister-engaging formation, thereby providing a double radiation-proof seal.

The lip may have a wedge-shaped profile which narrows towards the opening, and the U-shaped channel may have a complemental wedge-shaped cavity for accommodating the lip.

The re-entrant portion advantageously has an inwardly slanting face against which the outer surface of the wedge-shaped lip initially bears on insertion of the closure member, so as to splay open the elastically deformable outer wall prior to the lip locating in a snap fit within the wedge-shaped cavity.

BRIEF DESCRIPTION OF THE DRAWINGS

FIG. 1 shows a side view of a tamper-indicating film container of the invention which has not been tampered with;

FIG. 2 shows the tamper-indicating container of FIG. 1 which has been tampered with;

FIG. 3 shows a cross-section on the line 3—3 of FIG. 1;

FIG. 3A shows a detail of a first embodiment of a tamper-indicating seal;

FIG. 3B shows a detail of a second embodiment of a tamper-indicating seal;

FIG. 4 shows separate schematic cross-sectional side views of the canister and the cap which together form the assembled tamper-indicating container illustrated in FIGS. 1 and 2;

FIG. 5 shows a detailed view of the cap of FIG. 4, and

FIG. 6 shows a detailed view of the canister of FIG. 4.

DESCRIPTION OF EMBODIMENTS

The tamper-indicating 35 mm film container 10 illustrated in FIGS. 1, 2 and 4 includes a closure member or cap 12 engaged in a snap fit with a canister 14. The cap 12 is moulded from a translucent plastics material, and has an outer-peripheral canister-engaging portion 16 through which printed indicia 18 can be viewed. The printed indicia 18 may display written information relating to the type of film (PROFILM ABC), the number of exposures (36), the film speed (400), and the temperature below which the film should be stored (27° C.). Further information relating to the photographic film, including the expiry or "exposed by" date and other characteristics of the film may also form part of the printed indicia 18.

The printed indicia 18 are printed on and may form part of a tamper-indicating seal, which will presently be described in more detail with reference to FIGS. 3, 3A and 3B. As can be seen in FIG. 2, once the cap 12 has been removed from the canister 14, the tamper-indicating seal is destroyed, together with the indicia printed thereon, as is shown at 20.

Referring now to FIGS. 3 to 6, the cap 12 has an outer peripheral skirt, or outer wall section 24. The canister 14 has an upper lip or wall 26 which forms a snap-fit within a U-shaped channel 27 defined between the skirt 24 and an inner wall section 28 of the cap 12. The skirt 24 defines an outside wall which telescopes over an inside wall defined by the lip 26, when the cap is installed. A tamper-indicating seal 30 is laminated between those inside and outside walls, i.e., between the outer surface 32 of the lip 26 and the inner surface 34 of the skirt 24. The tamper-indicating seal comprises a strip of metallic foil 36 which is bonded to both the outer surface 32 of the lip 26 and the inner surface 34 of the skirt 24 by means of respective layers of adhesive 38 and 40. The indicia 18 are printed on the upper surface 42 of the foil 36. The bonding co-efficient of the layers of adhesive 38 and 40 to the respective outer and inner surfaces 32 and 34 and to the foil 36 is such that the foil 36 and the indicia 18 printed thereon constitute the weakest zone of fracture between the outer surface 32 of the lip 26 and the inner surface 34 of the skirt 24. As a result, if the film container 10 is opened by removal of the cap 12, the foil 36 and the indicia 18 are damaged, as can be seen at 20, thereby providing a clear indication that the film container has been tampered with.

Referring now to FIG. 3B, an alternative tamper-indicating seal 44 is shown in which the indicia 18 are in the form of indentations 45 moulded into the outer surface 32 of the lip 26. A suitable layer of paint or ink 46 is then applied to fill the moulded indentations 45 in order to make the indicia stand out more prominently. A layer of adhesive 48 is provided between the outer and inner surfaces of the respective lip 26 and skirt 24. The adhesive has a co-efficient of adhesion to the ink or paint 46 which is less than the co-efficient of adhesion between the ink or paint 36 and the outer layer 32 of the lip. As a result, once the cap 12 is removed it carries with it at least a portion of the indicia, thereby resulting in both the indicia and the tamper-indicating seal being damaged, the damaged indicia being clearly viewable through the skirt 24, as can be seen at 20.

Both the outer walls 50 and 52 of the respective canister 14 and cap 12 are formed from a translucent semi-rigid polyester material. The outer wall 50 of the canister 14 may alternatively be formed from an opaque material, such as polyester treated with a black pigment. An intermediate layer of lead shielding 54 and 56 is laminated between the respective outer walls 50 and 52 and respective inner layers 58 and 60 of the canister and the cap. The inner layers 58 and 60 are formed from a barium-impregnated polyethylene material. The outer walls 50 and 52 have a thickness of approximately 1 mm, while the lead shielding has a thickness of 0.2 mm, and the barium-impregnated polyethylene layer is 0.3 mm thick. The lead shielding 54 and 56 and the barium-impregnated polyethylene inner layers 58 and 60 provide, in conjunction, both light and X-ray shielding means to ensure that the photographic film housed within the container 10 is not damaged when passing through X-ray machinery at airport baggage checks, or the like. To this end, both the layers of lead shielding 54 and 56 and the inner layers of barium-impregnated polyethylene 58 and 60 completely line the side walls and base of the canister 14 and cap 12 respectively.

Referring now to FIGS. 5 and 6, the barium-impregnated polyethylene layer 60 terminates at the entrance to the channel 27 and the lead shield 56 has an exposed portion 56A which lines the outer surface of the inner wall 28 and a further exposed portion 56B which lines the base of the channel 27. The skirt 24 has a re-entrant portion 62 having an inwardly slanting front face 64, terminating in a curved recess 66 which merges with an inwardly slanting rear face 68. As can be seen more clearly in FIG. 3, the curved recess 66 forms a complemental fit with a curved shoulder 69 defining the base of the wedge-shaped lip 26. The lip 26 has an outer wedged surface 70 tapering inwardly towards the upper edge 72 of the canister 14. The wedged surface 70 forms a snug complemental fit with the inwardly slanting face 68, which defines one side of a wedge-shaped cavity 73. When the cap 12 is press-fitted onto the canister 14, the wedged surface 70 initially abuts the inwardly slanting face 64, thereby splaying the deformable semi-rigid skirt 24 away from the inner wall 28 and opening the channel 27 until the shoulder 69 snaps into position behind the recess 66.

As can be seen in FIG. 6, an exposed portion 74 of the lead shield 56 is urged against the exposed area 56B of lead shield at the base of the channel 27 when the lid is snapped into position. The barium-impregnated polyethylene layer 58 simultaneously abuts the portion of lead shield 56A lining the inner wall 28. The double shield at the interface of the canister 14 and the lid 12, constituted by the lead shield 56A, the barium-impregnated polyethylene layer 58 and the lead shield 54, ensures that there is no zone of weakness at the interface between the lid and the canister which is either X-ray or light pervious.

In an alternative embodiment of the invention, the cap may be formed from an opaque plastics material, with a translucent window being provided in the lip thereof for viewing the tamper-indicating seal. This embodiment has a possible disadvantage in that a more complicated manufacturing process is required in order to provide a cap having a separate window.

The tamper-indicating seal is not confined to the specific seals described in the embodiments, but may be in the form of any tamper-indicating seal interposed between the canister-engaging portion of the cap 12 and the canister 14. For instance, a stress-opacifying seal may be provided. Alternatively, the strip of foil or film may be embedded within a thermoplastic resin.

Furthermore, the indicia 18 need not necessarily form part of the tamper-indicating seal, but may be printed, moulded or embossed separately on the outer surface of the lip of the container or on the inner surface of the cap. The remainder of the outer surface 70 of the lip may be coloured differently, to the tamper-indicating seal, thereby serving to indicate clearly through the skirt when the cap has been removed and has been replaced with the tamper-indicating seal out of alignment. As can be seen clearly in FIG. 3, even though the cap 12, and possibly the canister 14 is translucent, the previously-referred-to double shield does not permit light or ionising radiation to pass completely through the walls of the container to the photographic film contained therein.

The tamper-indicating container of the invention is not necessarily confined to a film container, but may extend to any other container having contents which are radiation-sensitive, and which are liable to be tampered with.

The primary advantage of the film container of the invention is that it allows photographic film, especially high quality film, to be sold over-the-counter in the container of the invention, with the purchaser safe in the knowledge that the film has neither been tampered with, nor damaged by X-radiation. The need to remove the suitably protected photographic film from luggage which is to be X-rayed, or to house it in a separate X-ray-proof pouch, is also precluded.

It is foreseen that the film container of the invention will be of particular use to both serious amateur and professional photographers. The relatively minor additional costs of a container of this type are outweighed by its benefits; degradation of expensive unused film and damage to potentially valuable exposures is effectively avoided using this film container. The tamper-indicating seal also serves to indicate automatically to the photographer after having used several rolls of film, those canisters which house unexposed film and those canisters which house exposed film, without the need to mark the canisters individually or to open them.

I claim:

1. A tamper-indicating container comprising:

a canister having an opening defined therein;

a closure member for closing the opening;

each of the canister and closure member including at least one wall, the walls being telescoped together when the closure member is installed on the canister.

a tamper-indicating seal extending between the telescoped walls, the tamper-indicating seal incorporating indicia containing information relating to contents of the canister, and the indicia comprising indents formed in at least one of the portions of the telescoped walls, the indents being filled with a colored ink material, and a bonding agent being interposed between the ink material and the opposed contact surface, whereby removal of the closure member from the canister causes at least some of the ink material which is bonded to the bonding agent to be lifted away from the indents so as to indicate tampering; and shielding means on the canister and closure member for shielding the contents of the canister from ionizing radiation, the shielding means completely surround the contents when the closure member is installed on the canister.

2. A tamper-indicating container comprising:

a canister having an opening defined therein;

a closure member for closing the opening;

each of the canister and closure member including at least one wall, the walls being telescoped together when the closure member is installed on the canister;

a tamper-indicating seal extending between the telescoped walls; and shielding means on the canister and closure member for shielding the contents of the canister from ionizing radiation, the shielding means completely surrounding the contents when the closure member is installed on the canister, the shielding means comprising layers of lead and a layer of material containing barium which line the closure member and canister, respectively.

3. A tamper-indicating container as claimed in claim 2 in which the shielding means is constituted by an intermediate layer of lead bonded to an inner layer of barium-impregnated plastics material.

4. A tamper-indicating container as claimed in claim 3 in which the wall of the canister is constituted by the intermediate layer of lead laminated between the inner layer of barium-impregnated plastics material and an outer layer of a relatively rigid plastics material.

5. A tamper-indicating container comprising;

a canister having an opening defined therein;

a closure member for closing the opening;

each of the canister and closure member including at least one wall, the walls being telescoped together when the closure member is installed on the canister;

a tamper-indicating seal extending between the telescoped walls; and shielding means on the canister and closure member for shielding the contents of the canister from ionizing radiation, the shielding means completely surrounding the contents when the closure member is installed on the canister, the wall of the canister being provided with an outer peripheral lip adjacent the opening thereof, and the wall of the closure member comprising an inner wall section and an elastically deformable outer wall section defining in combination a substantially U-shaped channel complemental with the lip, the outer wall section having a re-entrant portion formed towards the free end thereof behind which the peripheral lip is adapted to engage in a snap fit.

6. A tamper-indicating container as claimed in claim 5 in which the shielding means extends to the upper edge of the lip of the canister and extends along the outer surface of the inner wall section of the closure member thereby providing a double radiation-proof shield.

7. A tamper-indicating container as claimed in claim 5 in which the lip has a wedge-shaped profile which narrows towards the canister opening, and the U-shaped channel has a complemental wedge-shaped cavity for accommodating the lip.

8. A tamper-indicating container as claimed in claim 7 in which the reentrant portion has an inwardly slanting face against which the outer surface of the wedge-shaped lip initially bears on insertion on the closure member, so as to splay open the elastically deformable outer wall section prior to the lip locating in a snap fit within the wedge-shaped cavity.

9. A tamper-indicating container comprising:

a canister having an opening defined therein;

a closure member for closing the opening;

each of the canister and closure member including at least one wall, the walls being telescoped together when the closure member is installed on the canister;

a tamper-indicating seal extending between the telescoped walls; and shielding means on the canister and closure member for shielding the contents of the canister from ionizing radiation, the shielding means completely surrounding the contents when the closure member is installed on the canister, wherein the telescoped walls define outside and inside walls, with a portion of the outside wall covering a portion of the inside wall, the tamper-proof seal being interposed between the portions of the outside and inside walls, the portion of the outside wall being transparent to enable the condition of the tamper-indicating seal to be viewed, and the tamper-indicating seal comprising a frangible strip laminated between adjacent contact surfaces of the outside and inside walls, the frangible strip being in the form of a printed strip of foil or film bonded by means of adhesive layers to the portions of the outside and inside walls.

* * * * *